US009216869B2

(12) United States Patent
Hildebrandt

(10) Patent No.: US 9,216,869 B2
(45) Date of Patent: Dec. 22, 2015

(54) DEVICE AND METHOD FOR CONTROLLING THE TRACKING OF A VALUE DOCUMENT STACK

(71) Applicant: GIESECKE & DEVRIENT GMBH, Munich (DE)

(72) Inventor: Thomas Hildebrandt, Pliening (DE)

(73) Assignee: GIESECKE & DEVRIENT GMBH, Munich (DE)

( * ) Notice: Subject to any disclaimer, the term of this patent is extended or adjusted under 35 U.S.C. 154(b) by 0 days.

(21) Appl. No.: 14/426,923

(22) PCT Filed: Sep. 6, 2013

(86) PCT No.: PCT/EP2013/002690

§ 371 (c)(1),
(2) Date: Mar. 9, 2015

(87) PCT Pub. No.: WO2014/037119

PCT Pub. Date: Mar. 13, 2014

(65) Prior Publication Data

US 2015/0274467 A1 Oct. 1, 2015

(30) Foreign Application Priority Data

Sep. 7, 2012 (DE) ..... 10 2012 017 770

(51) Int. Cl.
*G06F 7/00* (2006.01)
*B65H 7/20* (2006.01)
(Continued)

(52) U.S. Cl.
CPC ..... *B65H 7/20* (2013.01); *B65H 1/025* (2013.01); *B65H 1/04* (2013.01); *B65H 1/08* (2013.01);
(Continued)

(58) Field of Classification Search
CPC ..... B65H 1/04; B65H 1/08; B65H 7/02; B65H 7/04; B65H 7/10; B65H 7/14; B65H 7/18; B65H 7/20
USPC ..... 700/213, 219, 224
See application file for complete search history.

(56) References Cited

U.S. PATENT DOCUMENTS

| | | | | |
|---|---|---|---|---|
| 6,182,962 | B1 * | 2/2001 | Leuthold | B65H 1/24 271/126 |
| 2011/0051997 | A1 | 3/2011 | Nakano et al. | |
| 2012/0154795 | A1 * | 6/2012 | Kobayashi | B65H 1/14 356/213 |

FOREIGN PATENT DOCUMENTS

| | | | |
|---|---|---|---|
| DE | 1089329 | B | 9/1960 |
| EP | 0865398 | A1 | 9/1998 |

(Continued)

OTHER PUBLICATIONS

German Search Report for corresponding German Application No. 102012017770.4, May 28, 2013, (5 pages).

(Continued)

*Primary Examiner* — Mark Beauchaine
(74) *Attorney, Agent, or Firm* — Workman Nydegger

(57) ABSTRACT

For continuously singling value documents from a value document stack, the value document stack is lifted and fed toward the singler. For controlling the feed of the value document stack, an image of a side of the value document stack is recorded and evaluated, in order to recognize the edges of the individual value documents. The feed of the value document stack is controlled in dependence on the number of value document edges which are ascertained in the recorded image. If the number of value document edges cannot, or not sufficiently, be ascertained, additionally a brightness of the image in this image portion is ascertained. Upon the singling of the value documents imaged in this image portion the feed of the value document stack is controlled in dependence on the brightness ascertained in this image portion.

17 Claims, 3 Drawing Sheets

(51) Int. Cl.

| | |
|---|---|
| ***B65H 1/02*** | (2006.01) |
| ***B65H 1/14*** | (2006.01) |
| ***B65H 7/04*** | (2006.01) |
| ***B65H 7/14*** | (2006.01) |
| ***B65H 1/04*** | (2006.01) |
| ***B65H 1/08*** | (2006.01) |

(52) U.S. Cl.
CPC .. *B65H 1/14* (2013.01); *B65H 7/04* (2013.01); *B65H 7/14* (2013.01); *B65H 2511/30* (2013.01); *B65H 2513/10* (2013.01); *B65H 2513/40* (2013.01); *B65H 2515/60* (2013.01); *B65H 2553/42* (2013.01); *B65H 2701/1912* (2013.01)

(56) References Cited

FOREIGN PATENT DOCUMENTS

| | | | |
|---|---|---|---|
| EP | 1576552 | B1 | 2/2008 |
| EP | 2292539 | A2 | 3/2011 |
| WO | 2011161642 | A1 | 12/2011 |

OTHER PUBLICATIONS

International Search Report for corresponding International PCT Application No. PCT/EP2013/002690, Dec. 20, 2013, (6 pages).

* cited by examiner

DEVICE AND METHOD FOR CONTROLLING THE TRACKING OF A VALUE DOCUMENT STACK

BACKGROUND

The invention relates to an apparatus and a method for processing value documents, in particular for controlling the feed of a value document stack.

For EP0865398 B1 there is known a singler for value documents, by which value documents are singly withdrawn from a value document stack. Therein, a value document stack resting on a movable pressure plate is supplied to the singler by lifting the pressure plate. The singler has an advancing device, a singling roller and a retaining device. For singling the sheet material, the pressure plate is moved in the direction of the singler, until the value document stack is urged against the advancing device with slight pressure. Thereafter, the respective uppermost value document of the stack is moved by means of the advancing device in the direction of the singling roller which then singles the uppermost value document. As the number of value documents in the value document stack decreases with progressing singling, the pressure plate is continuously fed upward, in order to further lift the value document stack so that respectively the uppermost value document can be grasped by the advancing device of the singler.

For suitably feeding the value document stack, the density of the value documents in the stack is continuously determined during singling. The stack can thus be urged against the advancing device of the singler with a suitable pressure during the whole singling. For determining the density of the value document stack there is employed e.g. a camera which is directed to the side of the value document stack, in order to capture an image of the value document edges. By means of image processing the value document edges are recognized and therefrom the density of the value document stack is ascertained, i.e. the number of value documents in a certain section of the value document stack. In dependence on the ascertained number of value documents the distance between the pressure plate and the singler is controlled.

With the hitherto known image processing methods a recognition of the value document edges is not always possible, however. Therefore, image processing methods were proposed, which allow an improved edge recognition, e.g. in WO2011161642 A1. Furthermore, in EP1576552 B1 it was proposed to magnify the recorded image of the value document edges in the direction along the stack and to increase the number of pixels along the stack direction, so as to achieve a more accurate edge recognition. In the case of heavily used value documents for which the edge recognition does not work in the EP 1576552 B1 it was proposed to mechanically cut the value document stack, so that the used value documents obtain a new clean cut edge, and to subsequently carry out the edge recognition on the basis of the obtained clean cut edges.

SUMMARY

It is the object of the present invention to find an alternative solution for those cases in which the value document edges hitherto could not or not sufficiently be recognized.

While the prior art aims at further improving the edge recognition of the value document edges, in order to recognize also poorly recognizable value document edges, the invention moves away from this procedure. Because the invention makes it possible to control the feed of a value document stack also in the case when the recognition of value document edges is not working.

For controlling the feed of the value document stack, an image of a side of the value document stack is recorded. The recorded image of the side of the value document stack is evaluated, in order to recognize the edges of the individual value documents and in order to ascertain in the image a number of value document edges. The feed of the value document stack is controlled in dependence on the number of value document edges which are ascertained in the recorded image.

If upon the evaluation of the image in an image portion of the image the number of value document edges can be ascertained, upon the singling of the value documents imaged in the image portion the feed of the value document stack is controlled in dependence on the number of value document edges ascertained for this image portion.

If, however, upon the evaluation of the image, in an image portion of the image the number of value document edges cannot, or not sufficiently, be ascertained, the feed of the value document stack cannot be controlled on the basis of the number of value document edges present in this image portion. Instead, additionally a brightness of the image is ascertained in this image portion. And upon the singling of the value documents imaged in this image portion the feed of the value document stack is controlled in dependence on the brightness ascertained in this image portion.

If in the image portion in which the number of value document edges could not or not sufficiently be ascertained there is ascertained a great brightness, it is assumed that in the respective section of the value document stack value documents in very good condition are present. Since such value documents in a stack are usually densely stacked and thus form a value document stack of a greater density than heavily used value documents, a lower feed speed is chosen for such value documents. Therefore, if upon the singling of the value documents imaged in the image portion the number of value document edges cannot, or not sufficiently, be ascertained in the image portion and a great brightness is ascertained in the image portion, the feed is temporarily stopped or a low feed speed is chosen. For example, there is here chosen a lower feed speed than in the case when in the image portion in which the number of value document edges cannot, or not sufficiently, be ascertained a low brightness is ascertained.

By the invention it is achieved that in the case of densely stacked value documents whose edges are not recognized the feed is slowed down. It is thus avoided that dense value document stacks are urged too hard against the singler or the advancing device by the feed and that the value document stack is caught between the pressure plate and the singler.

If, however, in the image portion in which the number of value document edges could not, or not sufficiently, be ascertained there is ascertained a low brightness, it is assumed that in the respective section of the value document stack there are present value documents that are less densely stacked, e.g. value documents in poorer condition. In such a case the feed upon the singling of the value documents imaged in the image portion e.g. can remain unchanged. For example, the feed speed is so maintained as it was chosen before, i.e. as it was chosen for the value documents for which it was most recently possible to ascertain a number of value document edges. The feed speed is e.g. so maintained as it was chosen on the basis of an earlier ascertained number of value document edges, which was ascertained in an earlier evaluated image portion of the same value document stack. Or the feed remains stopped, if it was stopped before. Alternatively, the feed speed is set to a value which was predefined for less densely stacked value documents. Alternatively, also the feed and, where applicable, also the singling of the value documents can be stopped. Stopping the singler may be expedient, when it is suspected that faulty value documents or folded value documents or foreign objects are located in the respective image portion in which no value document edges and a low brightness were established.

For example, the feed of the value document stack, upon the singling of the value documents imaged in this image portion, is controlled in dependence on the brightness ascertained in this image portion, in such a way that with increasing brightness of the image portion the feed speed is reduced step by step or continuously. The reducing of the feed speed may also comprise a temporary stopping of the feed. E.g., there can be chosen various steps for the feed speeds in dependence on the ascertained brightness, e.g. in case of a low brightness a high feed speed, in case of an average brightness an average feed speed and in case of a great brightness a low feed speed or even a stopping of the feed.

Additionally, also the singling rate with which the value documents are singled can be controlled in dependence on the brightness ascertained in the respective image portion. For example, a decreasing brightness of the image portion will be employed as an indication of a poorer condition of the value documents. With decreasing brightness of the image portion the singling rate is then reduced, in order to avoid disturbances upon the singling of value documents of poor condition. For example, when a brightness threshold is undershot, a slightly lower singling rate is chosen. This brightness threshold generally differs from the brightness threshold that is relevant for the feed.

The image portion in which the number of value document edges is ascertained can be the entire recorded image or only a part of the recorded image. The image portion is e.g. chosen such that the next ones of the value document stack's value documents to be singled are imaged therein. Preferably, the image portion lies in that section of the value document stack, which faces the singler. The image portion to be evaluated can also be subdivided into several image portions, in which respectively a number of value document edges is ascertained. These image portions can e.g. be mutually shifted and border each other along the stack direction.

The image portion of the image, in which the edge recognition is carried out and the number of the edges is ascertained, can be a contiguous two-dimensional image portion. Alternatively, the image portion can also consist of several image strips which extend parallel to each other and perpendicular to the stack direction of the value document stack in such a way that in these image strips the same value documents of the value document stack are imaged. The edge recognition is then accordingly carried out for the two-dimensional image portion or for these image strips.

In order to evaluate the brightness of the image portion in which the number of value document edges could not, or not sufficiently, be ascertained, this brightness can be compared with a brightness threshold. But there can also be employed several brightness thresholds, in order to evaluate the brightness. If the number of value document edges in the image portion cannot, or not sufficiently, be ascertained and the brightness in the image portion exceeds the brightness threshold, the feed is temporarily stopped or the feed speed is reduced. For example, upon the singling of the value documents imaged in this image portion a lower feed speed is chosen than in the case when in this image portion there is ascertained a brightness which does not exceed the brightness threshold. For example, upon the exceeding of the brightness threshold a feed speed can be chosen, which is lower than the feed speed in the case when value document edges are recognized in the image portion.

The feed speed, which was reduced due to the ascertained brightness, remains reduced until in a later recorded image portion, e.g. in the next-evaluated image portion of the following value documents of the value document stack, there can again be ascertained a number of value document edges. As soon as in a later recorded image portion a number of value document edges can again be ascertained, the feed speed for the value documents which are imaged in the later recorded image portion can again be chosen in dependence on the number of the value document edges.

If upon the evaluation of the image the number of value document edges can be ascertained in an image portion of the image, the brightness of the image does not have to be ascertained in the relevant image portion, but the feed speed can be chosen—without taking into consideration the brightness—only in dependence on the number of the value document edges recognized in the respective image portion. Optionally, also in the case that the value document edges were recognized, the brightness of the image can be ascertained, evaluated and additionally be employed for controlling the feed.

The recorded image is e.g. a grayscale image. The brightness of the image results from the pixel intensities of the image, e.g. in the visible and/or in the infrared spectral region. As a measure for the brightness of the image in the image portion there is formed e.g. a mean value of the pixel intensity over the image portion.

For ascertaining the brightness in the image portion, the frequency distribution of the pixel intensities in the image portion can be ascertained. The feed is controlled e.g. in dependence on the location of the mean value of the frequency distribution and/or in dependence on the width (e.g. full width at half maximum or standard deviation) of the frequency distribution. For example, a low width (narrow frequency distribution) can be employed as an indication of the presence of a homogeneous stack of value documents. In case of a great brightness mean value and low width of the frequency distribution one infers the presence of value documents in very good condition. In case of a great width one infers the presence of used value documents or an inhomogeneous stack of value documents.

The invention also relates to an apparatus for controlling the feed of a value document stack from which the value documents are to be singled. The apparatus has an image sensor, an evaluation device for evaluating the image recorded by the image sensor and a control device for controlling the feed of the value document stack.

The image sensor is arranged in the proximity of the singler in such a way that it can record an image of a side of the value document stack. The image sensor captures the image of a side of the value document stack, i.e. from a direction which extends perpendicular to the stack direction of the value document stack. The image sensor preferably is a two-dimensional image sensor. The value document stack, from which the value documents are to be singled by means of the singler, is fed in order to respectively bring the uppermost value document of the value document stack into the grasping region of an advancing device of the singler. The value document stack rests on e.g. a pressure plate which is moved in the direction of the singler, in order to feed the value document stack to the singler.

The evaluation device is connected with the image sensor and receives image data of the recorded image therefrom. The evaluation device is configured to evaluate the image of the side of the value document stack recorded by the image sensor, in order to recognize the edges of the individual value documents in an image portion of the image and in order to ascertain a number of value document edges and, where applicable, the brightness of the image in the image portion. The evaluation device e.g. has corresponding hardware circuits and/or a corresponding software program for the edge recognition. The evaluation device tests whether it can ascertain, upon the evaluation of the image, the number of value document edges in a provided image portion of the image. If it cannot, or not sufficiently, ascertain the number of value document edges, the evaluation device ascertains additionally a brightness of the image in this image portion.

The evaluation device is connected with a control device which is configured for controlling the feed of the value document stack in dependence on the number of value document edges which the evaluation device has ascertained in the recorded image. For example, for this purpose in the control device there are provided two or more feed modes which can be realized through corresponding hardware and/or software of the control device. The evaluation device sends the information about whether the recognition of the value document edges was successful, as well as, where applicable, the number of value document edges and, where applicable, the brightness of the image portion to the control device. The control device controls the feed of the value document stack, upon the singling of the value documents imaged in this image portion, in dependence on the ascertained number of value document edges and in dependence on the brightness which the evaluation device has ascertained in the image portion of these value documents. The control device chooses the feed mode in dependence on the number of value document edges and, if this is not possible, in dependence on the brightness of the image portion. In the feed mode it is specified whether the value document stack is fed, and if so, with which speed the value document stack is fed. For feeding, the control device prompts a corresponding motion of the pressure plate which supplies the value document stack to the singler.

The image sensor can also be configured to autonomously check itself for soiling, and this preferably at a time at which there is no value document stack in its field of view. If then a too low brightness is detected, one infers a soiling of the image sensor. As a result of the soiling, an automatic cleaning of the image sensor or of an upstream lens or window can be effected (e.g. by blowing on) or a corresponding message can be output by the apparatus for value-document processing, e.g. in order to request an operator to clean the image sensor, the lens or the window.

Advantageously, on that side of the value document stack that lies opposite the image sensor, there can be attached a reference area, so that at times when no value document stack is located in the field of view of the image sensor the brightness of the image recorded by the image sensor is determined by the reference area. It is thereby achieved that the recorded image of the value document stack has a defined background brightness. The reference area makes it possible to detect from time to time a reference brightness which is included in the image evaluation. For example, the brightness threshold with which the detected brightness of the image portion is compared is chosen in dependence on the reference brightness which the image sensor detects from the reference area (without a value document stack being present). The reference area can be configured in swivelable fashion or be firmly installed. Preferably, the reference area has—as far as it lies in the field of view of the image sensor—a uniform brightness.

The invention also relates to a singling apparatus which has an apparatus for controlling the feed, as well as to an apparatus for value-document processing which has such a singling apparatus. The singling apparatus contains e.g. an advancing device, a singling element (e.g. roller) and a retaining device as well as, where applicable, the pressure plate for receiving and for feeding the value document stack. The apparatus for value-document processing further has a transport system for transporting the value documents, sensors for checking the value documents and, where applicable, one or several output pockets and/or storage containers for the value documents.

BRIEF DESCRIPTION OF THE DRAWINGS

Hereinafter the invention will be explained with reference to Figures. There are shown:

FIG. 1*a* top view of an apparatus for value-document processing,

DETAILED DESCRIPTION OF VARIOUS EMBODIMENTS

Figure 1A:
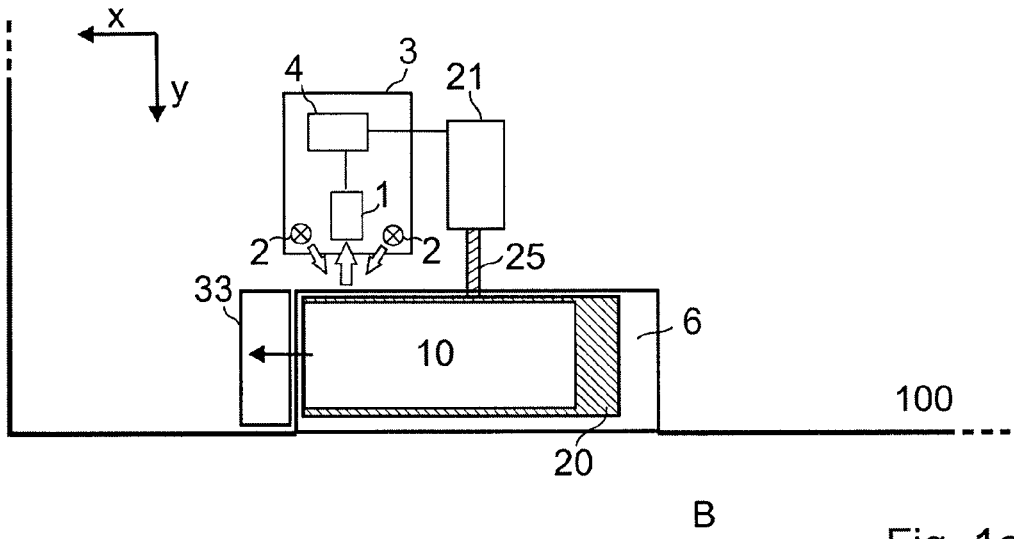

FIG. 1*a* shows by way of example a bird's-eye view of a detail of an apparatus 100 for processing value documents from above (z direction) onto the region of the singler 30 of the apparatus 100. From the operator side B of the apparatus 100 a value document stack 10 was inserted into the singler pocket 6 of the apparatus 100. The value document stack 10 rests on a movable pressure plate 20 which can be moved up and down (z direction), in order to supply the stack 10 to the singler 30 of the apparatus 100. With the aid of the singler roller 33 respectively the uppermost value document is withdrawn from the value document stack 10 along the x direction. For a better representation, the further components of the singler 30 and of the apparatus 100, which are located between the viewer's bird's-eye view and the value document stack 10, are omitted in FIG. 1*a*.

The apparatus 100 has a camera module 3 which is arranged in the internal space of the apparatus at that side of the singler 30 which faces away from the operator side B of the apparatus 100. The camera module 3 is directed from the internal space of the apparatus 100 into the singler pocket 6, in order to record an image of the value document stack 10 from the side of the value document stack. The value document stack 10 is viewed in the y direction here. The image sensor 1 of the camera module 3 is arranged such that it can record an image of that side of the value document stack 10 which faces the internal space of the apparatus 100. For illuminating the value document stack 10, at the camera module 3 there are provided two light sources 2 which send out flash light in mutual synchronism. The image recorded by the image sensor 1 is evaluated by means of an evaluation device 4 which carries out an image processing, in order to recognize the edges of the individual value documents and to ascertain from the recorded image the number of value document edges or the density of the value documents. For this purpose, the image portion is subjected to an edge recognition method, e.g. with the aid of edge operators, as they are known from the prior art. The evaluation device 4 is connected with the control device 21 of the pressure plate 20, which control device controls the motion of the pressure plate 20 along the z direction.

Figure 1B:
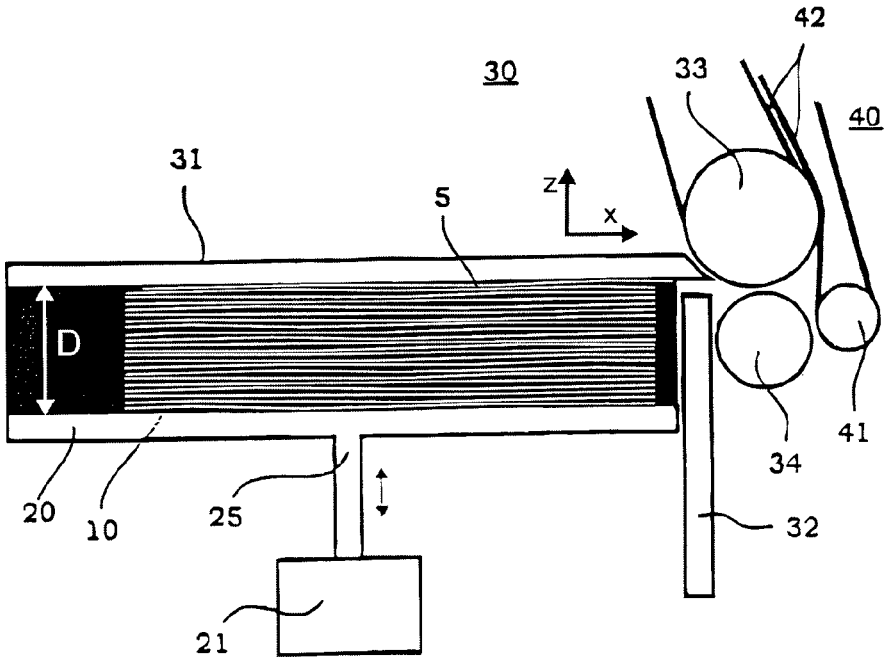
FIG. 1*b* side view of the singler of the apparatus.

FIG. 1*b* shows a side view of the singler 30, viewed from the side of the camera module 3. The singler 30 in this example has an advancing device 31, a retaining device 32, a singling roller 33 and a retaining roller 34. The advancing device here is configured as an air baffle plate, which sucks the uppermost value document and moves it in the x direction, but can also be realized differently, e.g. by advancing rollers etc.

For singling the value document stack 10, the uppermost value document 5 is transported by the advancing device 31 in the direction of the singling roller 33 (x direction). This then grips the uppermost value document and withdraws it from the stack 10. The value documents of the stack 10 which follow the uppermost value document are retained by the retaining device 32. In the case that several value documents are transported in the direction of the singling roller 33 by the advancing device 31, there is additionally provided the retaining roller 34 which then transports the following value documents back to the stack 10. The value document singled by the singling apparatus 30 is then transferred to a transport system 40. This has e.g. transport rolls 41 by means of which transport belts 42 are moved. For the transport, the respective value document is clamped between the transport belts 42.

Since the number of value documents in the value document stack 10 decreases with progressing singling of the value documents, the pressure plate 20 is fed along the z direction with the aid of a motor to further lift the value document stack. Thus, respectively the uppermost value document 5 comes into the grasping region of the advancing device 31 and can be singled. The feed speed with which the pressure plate 20 is moved upward is chosen differently great in dependence on the density of the value document stack 10, however. In case of loosely stacked value documents (low stack density) the stack 10 is fed with relatively great speed, in order to achieve a high singling rate. In case of a dense value document stack 10 the feed is slowed down or temporarily stopped, so that no disturbance of the singling occurs. For adjusting the distance D between the pressure plate 20 and the advancing device 31 during the singling to the density of the value documents to be respectively singled, the motion of the pressure plate 20 along the z direction is controlled by means of the control device 21. The control device 21 controls the actuating device 25 which is mechanically connected with the pressure plate 20.

Figure 2A:
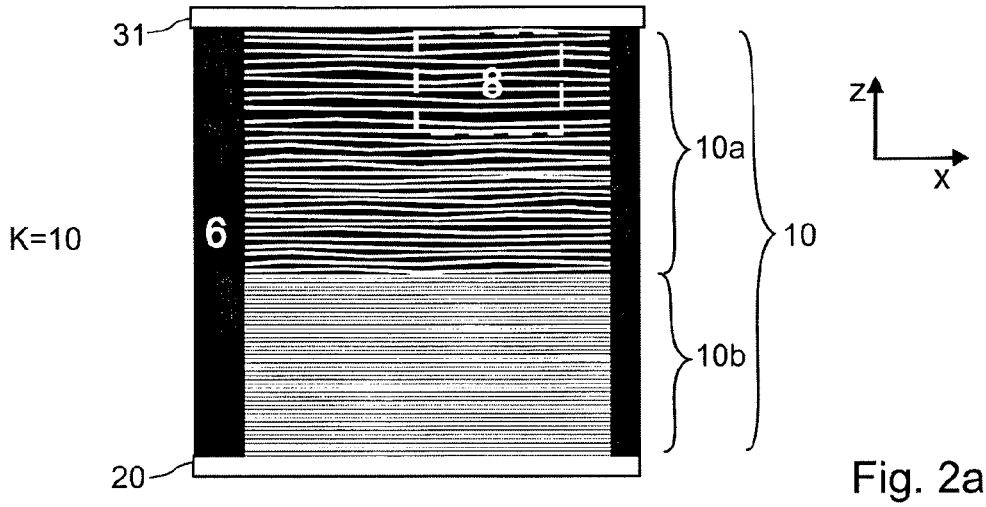
FIG. 2*a-d* side views of a value document stack and image portion in which a recognition of the value document edges is successful (FIG. 2*a-b*), partly successful (FIG. 2*c*) and not successful (FIG. 2*d*), FIG. 3*a-d* four examples for the frequency distribution of the pixel intensities in an image portion in which it was impossible to ascertain the number of value document edges.

The density of the value document stack is ascertained from the number K of value document edges which are recognized in an image portion 8. FIG. 2*a* sketches an image portion 8 suitable for this purpose, which the image sensor 1 records from the side of the value document stack 10. If the edge recognition in the image portion 8 is successful, the control device 21 receives from the evaluation device 4 information about the currently present number K of value document edges which were recognized in the image portion 8. The number K of value document edges is e.g. continuously ascertained during the singling of the value documents. The control device 21 controls the feed of the pressure plate 20 in dependence on this number K of value document edges. For example, the distance D between the pressure plate 20 and the singler 30 is adjusted in dependence on the ascertained number K of value document edges such that the stack 10 is slightly urged against the advancing device 31.

The image portion 8 is preferably recorded in that side portion of the value document stack which is located in the proximity of the singler 30 (in FIG. 2*a* top right). The image portion 8 preferably comprises those value documents which will be singled next, directly before these are singled. The number K of value documents respectively ascertained from the image portion can then be directly, more or less without delay, employed for controlling the motion of the pressure plate 20. The respective number K of value document edges and/or the image data can also be permanently or temporarily stored, however. By storing the number K, the number K ascertained in the respective image portion can be ascertained already before the value documents are singled and only be called up and employed for controlling when the respective value documents are actually singled. By storing the number K it is thus possible that the image sensor 3 can also be arranged, along the z direction, in some distance to the singler 30.

The value document stack 10 resting on the pressure plate 20, in the example from FIG. 2*a*, consists of an upper stack portion 10*a* and a lower stack portion 10*b*. In the upper stack portion 10*a* there are located used value documents which have a certain waviness and thus are stacked with relatively low density. The lower stack portion 10*b* contains value documents having infinitesimal waviness, which are very densely stacked, e.g. value documents that are hardly used or new value documents.

Figure 2B:
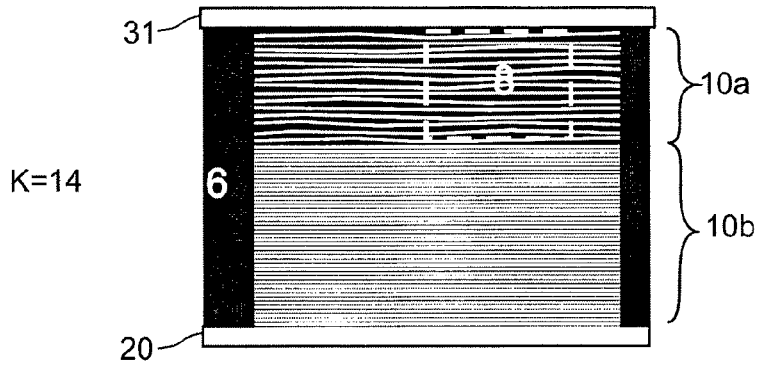

In the example of FIG. 2*a*, in the image portion 8 in which the used value documents of the upper stack portion 10*a* are imaged ten value document edges are recognized. FIG. 2*b* shows the value document stack of FIG. 2*a*, after a part of the upper stack portion 10*a* has already been singled. The image portion 8 of FIG. 2*b* comprises thus only the lower value documents of the upper value document stack 10*a*. Fourteen value document edges are imaged therein. The ten value document edges of the image portion 8 of FIG. 2*a* and the fourteen value document edges of the image portion 8 of FIG. 2*b* can be recognized with the aid of the usual image processing methods for edge recognition.

For example, the feed of the pressure plate 20 is controlled in dependence on the number K of value documents which were recognized in the image portion 8. Thus, e.g. in the case of the ten value document edges in FIG. 2*a* there can be chosen a feed speed G2 which is greater than a feed speed G1 which is chosen in the case of the fourteen value document edges of FIG. 2*b*.

Alternatively, in both cases there can also be chosen the same feed speed of the pressure plate 20, however. For example, a number Z of value document edges can be prescribed as a threshold, e.g. Z=20, and in all the cases in which the number ascertained in the image portion 8 lies below the threshold Z, a predetermined feed speed G can be set. If Z or more than Z value document edges are recognized in the image portion 8, the feed is effected slower or is temporarily stopped.

Figure 2C:
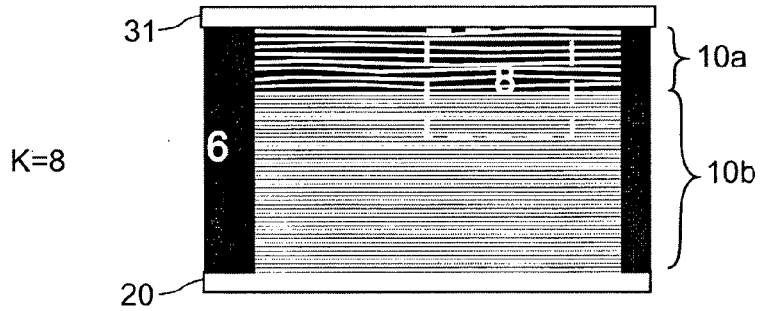

FIG. 2*c* shows a case, in which in the image portion 8 there are imaged both a part of the upper value document stack 10*a* and a part of the lower value document stack 10*b*. Since the edge recognition is successful only in the upper part of the image portion 8, in this case a low number of K=8 value document edges is recognized. The evaluation can again be carried out on the basis of the just-mentioned threshold comparison. Since the number K=8 value document edges lies below the threshold Z=20, then again the predetermined feed speed G would be chosen.

Figure 2D:
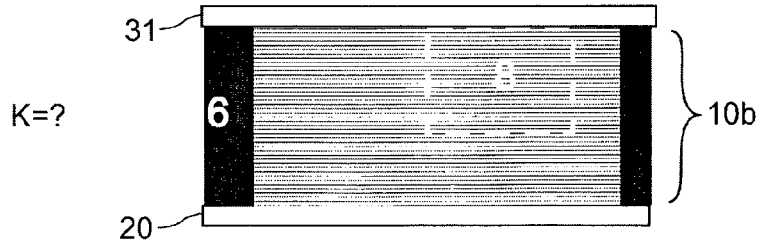

In FIG. 2*d* there is shown the value document stack 10, after all the value documents of the upper stack portion 10*a* have already been singled, so that in the image portion 8 there are contained only the densely stacked value documents of the lower stack portion 10*b*. With such a great stack density, the number K of value document edges cannot, or not sufficiently, be determined ("K=?"), because by the image processing too few or no value document edges at all are recognized. But not only the density, also the color or the soiling of the value documents may impair the recognition of the value document edges, or also a misorientation or a very great waviness of the value documents contained in the stack 10. In those cases when the number of value document edges in the image portion 8 cannot, or not sufficiently, be ascertained, there is thus additionally ascertained the brightness of the image in the image portion 8. And the feed of the value document stack 10 is then controlled in dependence on the ascertained brightness of the image portion 8.

Figure 3A:
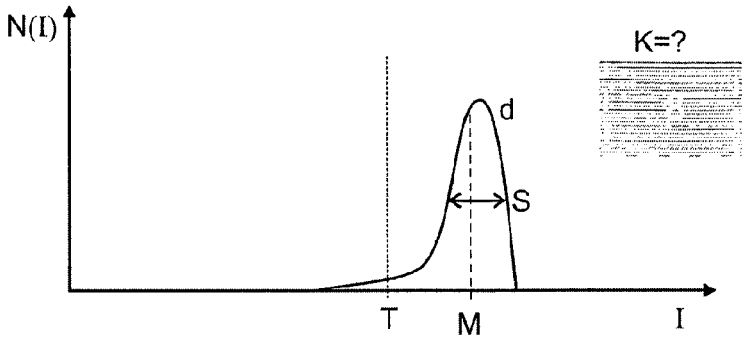

For the image portion 8 of FIG. 2*d* there is sketched in FIG. 3*a* the frequency distribution d of the brightness of the image portion 8, here in schematic fashion a histogram N(I) of the pixel intensities I of all the image points of the image portion 8. In the embodiment of the FIG. 3*a* there is analyzed the frequency distribution d, in order to control the feed of the value documents on the basis of parameters of this frequency distribution d, also in the case when no number K of value document edges can be ascertained. As parameters for controlling the feed there are employed e.g. the location and/or the width S of the frequency distribution.

As a measure for the location of the frequency distribution there can be determined e.g. the mean value M of the frequency distribution and be compared with a threshold T which was e.g. specified prior to the value-document processing. If the mean value M exceeds the threshold T, as it is the case with the frequency distribution d of FIG. 3*a*, the image portion 8 has a relatively great brightness. This is employed as an indication that in the image portion 8 there are imaged value documents which are very densely stacked and thus appear bright. In this case, the feed of the value document stack 10*b* with the aid of the pressure plate 20 is temporarily stopped or it is chosen a low feed speed G0 which is lower than the above-stated feed speeds G or G1 and G2.

Figure 3B:
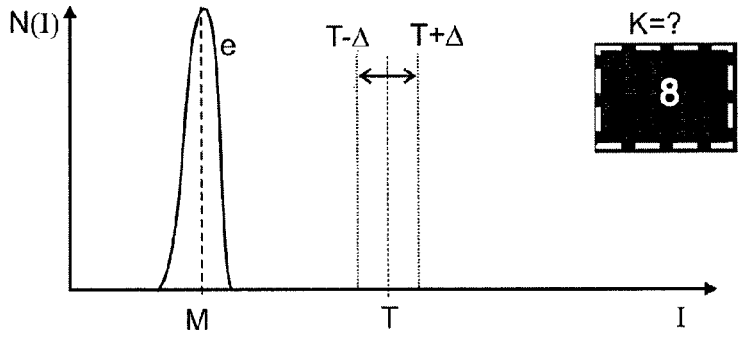

FIG. 3*b* shows the case when in the image portion 8 no value documents at all are imaged, e.g. when the singler pocket 6 is empty. In this case, too, no value document edges can be ascertained in the image portion by the image processing. Since in this case in the image portion 8 only the dark background of the singler pocket 6 appears, the frequency distribution e lies at a substantially lower brightness or pixel intensity I and thus clearly below the threshold T. The fact that the mean value M of the frequency distribution e—in contrast to the frequency distribution d—undershoots the threshold T is employed as an indication that it was impossible to ascertain a number of value document edges not due to a dense value document stack, but for a different reason. When the mean value M undershoots the threshold T, the feed speed is for example maintained or is set to the above-stated feed speed G or G2, which is also employed in the case when in the image portion a low number K of value document edges is ascertained.

The brightness threshold T can also be provided with a brightness interval T+/−Δ, see FIG. 3*b*, and the mean value M be checked for exceeding the upper limit T+Δ of the brightness interval and for undershooting the lower limit T−Δ of the brightness interval.

Alternatively or additionally to the location M of the frequency distribution, also the width S of the frequency distribution can be taken into consideration, e.g. the full width at half maximum. As a measure for the width S there can also be employed the standard deviation of the pixel intensity I in the image portion 8. For example, there is employed—additionally to the location of the mean value M above the threshold T—also a low width S as an indication of the presence of a very dense stack (the case of FIG. 3*a*).

Figure 3C:
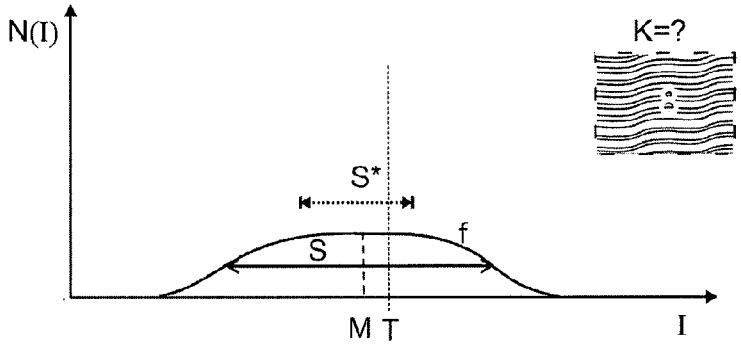

If, however, the width S is great, e.g. greater than a prescribed width limit value S*, as it is the case with the frequency distribution f of the FIG. 3*c*, this is taken as an indication that the problems in edge recognition occur not because of the great density of the stack and not due to missing value documents, but for a different reason. The reason may be e.g. a great waviness of the value documents, cf. the image portion 8 shown in FIG. 3*c*, or a misorientation of the value documents. A great width S can also be present when in the image portion 8 there is imaged a relatively inhomogeneous value document stack consisting of different types or qualities of value documents.

Figure 3D:
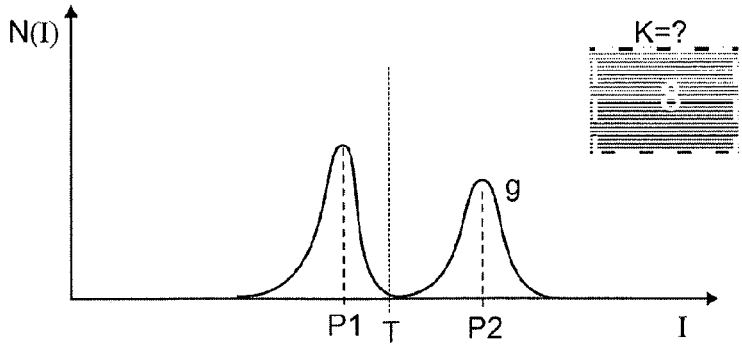

If the number K of the edges cannot be determined, and neither the location M nor the width S of the frequency distribution suggest any of the above-stated cases, the evaluation can also be restricted to a part of the image portion 8. This can e.g. be helpful when in the image portion 8 there are contained different qualities of value documents, as it is the case in the example of FIG. 3*d*. There, in the image portion 8 on the top there is imaged a dense partial stack of bright value documents and at the bottom a dense partial stack of slightly darker value documents. As the location and standard deviation of the associated frequency distribution g do not allow a clear conclusion, the frequency distribution is evaluated only for the upper half of the image portion 8. In the case of FIG. 3*d*, the frequency distribution of the upper half of the image portion 8 would have only the right one of the two peaks P2 of FIG. 3*d*. The location and width of the peak P2 indicate the presence of a dense value document stack (analogous to the case of FIG. 3*a*), which is to be fed with low speed or whose feed should be stopped.

But also a more elaborate analysis of the frequency distribution can be carried out, e.g. a compensation calculation for the identification of curve peaks. By a more elaborate analysis there can be identified the two peaks P1, P2 of the frequency distribution g and their location and width be employed for controlling the feed. The width of these two peaks P1, P2 is relatively low and suggests two homogeneous partial stacks of densely stacked value documents. The location of the peaks on the intensity axis I indicates that one of the partial stacks consists of bright value documents and the other partial stack of slightly darker value documents. Due to the great density of the two value document stacks, the feed should accordingly be slowed down or stopped while these are singled.

In those cases in which the evaluation of the image portion 8 suggests none of the above-mentioned cases, the feed speed can be maintained as it was chosen on the basis of the number K' of value document edges of an earlier evaluated image portion 8' of the value document stack 10, or be set to a predefined feed speed.

If despite the controlling of the feed there still occur problems with the singling of the value documents, the singling is stopped and the apparatus 100 outputs a corresponding message.

The images recorded by the image sensor 1, on which the side of the value document stack 10 to be singled is imaged, can be represented on a display device of the apparatus 100, e.g. on a display screen. Representing the recorded images is preferably effected in real time with the singling of the value documents, whereby it is possible to show the images live or immediately after the recording of the images to an operator or a service person of the apparatus. The images comprise e.g. respectively the image portion 8 on the basis of which the feed of the stack is controlled and/or respectively the uppermost value document which is presently singled. Due to the pulsed illumination by means of the light sources, the fast sequence of the individual, recorded images results in a kind of movie which can be employed for manually optimizing the parameters for controlling the feed and/or the singling parameters of the singler.

The invention claimed is:

1. A method for controlling the feed of a value document stack from which value documents are singled, having the steps:

recording, with an image sensor, an image of a side of the value document stack;

evaluating, with an evaluation device, the recorded image of the side of the value document stack, in order to recognize the edges of the individual value documents in an image portion of the image and in order to ascertain a number of value document edges in the image portion;

controlling, with a controlling device, the feed of the value document stack in dependence on the number of the value document edges which were ascertained in the image portion;

wherein:

that upon the evaluation of the recorded image, if in the image portion the number of value document edges cannot, or not sufficiently, be ascertained, additionally a brightness of the image is ascertained in this image portion; and that upon the singling of the value documents imaged in this image portion the feed of the value document stack is controlled in dependence on the brightness ascertained in this image portion.

2. The method according to claim 1, wherein the feed of the value document stack, upon the singling of the value documents imaged in this image portion, is controlled in dependence on the brightness ascertained in this image portion in such a way that with increasing brightness of the image portion the feed speed is reduced.

3. The method according to claim 1, wherein, additionally to the feed of the value document stack, also the singling rate with which the value documents are singled is controlled in dependence on the brightness ascertained in the image portion, wherein the singling rate in particular is reduced with decreasing brightness of the image portion.

4. The method according to claim 1, wherein upon ascertaining the brightness of the image in the image portion there is formed a mean value of the pixel intensity in the image portion as a measure for the brightness of the image in the image portion and the feed of the value document stack is controlled in dependence on this mean value.

5. The method according to claim 1, wherein the brightness ascertained in the image portion is compared with a brightness threshold.

6. The method according to claim 5, wherein in the case when the brightness ascertained in the image portion exceeds the brightness threshold the feed upon the singling of the value documents imaged in this image portion is temporarily stopped or that upon the singling of the value documents imaged in this image portion a lower feed speed is chosen than in the case when the brightness ascertained in this image portion does not exceed the brightness threshold.

7. The method according to claim 5, wherein in the case when the brightness ascertained in the image portion exceeds the brightness threshold the feed upon the singling of the value documents imaged in this image portion is temporarily stopped or that upon the singling of the value documents imaged in this image portion a lower feed speed (G0) is chosen than in the case when value document edges are recognized in the image portion.

8. The method according to claim 5, wherein in the case when the brightness in the image portion ascertained in this image portion does not exceed the brightness threshold, the feed upon the singling of the value documents imaged in the image portion remains unchanged or the feed speed is set to a feed speed predefined for this case.

9. The method according to claim 1, wherein upon the evaluation of the recorded image, if in an image portion of the image the number of value document edges cannot, or not sufficiently, be ascertained, for ascertaining the brightness the frequency distribution of the brightness in the image portion is ascertained and the feed of the value document stack is controlled in dependence on the location of the frequency distribution and/or in dependence on the width of the frequency distribution.

10. The method according to claim 9, wherein due to the brightness ascertained in the image portion the feed of the value document stack is stopped under the condition or the feed speed thereof is reduced under the condition that the width of the frequency distribution in the image portion lies under a prescribed width limit value.

11. The method according to claim 9, wherein due to the brightness ascertained in the image portion the feed of the value document stack is stopped under the condition or the feed speed is reduced under the condition that the mean value of the frequency distribution in the image portion exceeds a prescribed threshold.

12. The method according to claim 11, wherein due to the brightness ascertained in the image portion the feed of the value document stack is stopped under the condition or the feed speed thereof is reduced under the condition that the width of the frequency distribution in the image portion lies under a prescribed width limit value.

13. The method according to claim 12, wherein the feed which was stopped due to the ascertained brightness or whose speed was reduced due to the ascertained brightness remains unchanged as long as in a later recorded image portion again a number of value document edges can be ascertained.

14. An apparatus for controlling the feed of a value document stack from which the value documents are to be singled, comprising:

an image sensor for recording an image of a side of the value document stack;

an evaluation device for evaluating the recorded image, which is configured to evaluate the image of the side of the value document stack, in order to recognize the edges of the individual value documents in an image portion of the image and in order to ascertain a number of value document edges in the image portion;

a control device for controlling the feed of the value document stack in dependence on the number of value document edges which the evaluation device has ascertained in the image portion;

wherein the evaluation device ascertains, if upon the evaluation of the recorded image in the image portion it cannot, or not sufficiently, ascertain the number of value document edges, additionally a brightness of the image in this image portion; and that the control device controls the feed of the value document stack for the value documents imaged in this image portion in dependence on the brightness ascertained in this image portion.

15. The apparatus according to claim 14, wherein the control device is configured to record an image of a side of the value document stack;

evaluate the recorded image of the side of the value document stack, in order to recognize the edges of the individual value documents in an image portion of the image and in order to ascertain a number of value document edges in the image portion;

control the feed of the value document stack in dependence on the number of the value document edges which were ascertained in the image portion;

wherein:

that upon the evaluation of the recorded image, if in the image portion the number of value document edges cannot, or not sufficiently, be ascertained, additionally a brightness of the image is ascertained in this image portion; and that upon the singling of the value documents imaged in this image portion the feed of the value document stack is controlled in dependence on the brightness ascertained in this image portion.

16. A singling apparatus for singling value documents from a value document stack, which is configured to single the value documents from the value document stack and which has an apparatus for controlling the feed of the value document stack according to claim 14.

17. An apparatus for processing value documents, which has a singling apparatus according to claim 16.

* * * * *